US010316479B2

(12) United States Patent
Green

(10) Patent No.: US 10,316,479 B2
(45) Date of Patent: Jun. 11, 2019

(54) QUEUE MANAGEMENT GATE

(71) Applicant: SHORTCUTQ LTD, London (GB)

(72) Inventor: Jonathan Green, Santa Cruz de Tenerife (ES)

(73) Assignee: SHORTCUTQ LTD, London (GB)

( * ) Notice: Subject to any disclaimer, the term of this patent is extended or adjusted under 35 U.S.C. 154(b) by 572 days.

(21) Appl. No.: 15/023,948

(22) PCT Filed: Sep. 23, 2014

(86) PCT No.: PCT/IB2014/064766
§ 371 (c)(1),
(2) Date: Mar. 22, 2016

(87) PCT Pub. No.: WO2015/040602
PCT Pub. Date: Mar. 26, 2015

(65) Prior Publication Data

US 2016/0244923 A1 Aug. 25, 2016

(30) Foreign Application Priority Data

Sep. 23, 2013 (AU) ..... 2013903643
Aug. 22, 2014 (NL) ..... 2013358

(51) Int. Cl.
*E01F 13/02* (2006.01)
*E01F 13/06* (2006.01)
(Continued)

(52) U.S. Cl.
CPC ..... *E01F 13/022* (2013.01); *E01F 13/028* (2013.01); *E01F 13/04* (2013.01); *E01F 13/06* (2013.01); *E06B 11/08* (2013.01)

(58) Field of Classification Search
CPC ..... E01F 13/00; E01F 13/02; E01F 13/022; E01F 13/024; E01F 13/028; E01F 13/04; E01F 13/06; E06B 11/02; E06B 11/08
See application file for complete search history.

(56) References Cited

U.S. PATENT DOCUMENTS 4,829,687 A * 5/1989 Rumpf ..... E01F 13/06 248/288.31
4,897,960 A * 2/1990 Barvinek ..... B61L 29/02 49/192
(Continued)

FOREIGN PATENT DOCUMENTS

DE 1946060 U 9/1966
DE 9110591 U1 1/1992
(Continued)

OTHER PUBLICATIONS

Lavi Industries Catalog No. 0507; 2006.
(Continued)

*Primary Examiner* — Jonathan P Masinick
(74) *Attorney, Agent, or Firm* — Reichel Stohry LLP; Mark C. Reichel; Natalie J. Dean

(57) ABSTRACT

Queue management systems allow a long queue/line of people to be held in a relatively small area. However, if there is no queue/line the system may frustrate users. The invention provides in one aspect a queue management gate 110 comprising an attachment device 150 for attaching the queue management gate to a stanchion 30 of the type used in queue management systems which include flexible tapes extending between stanchions to form lanes, the gate further comprising a relatively rigid movable barrier 60, movable in a substantially horizontal plane, the gate for allowing access between adjacent lanes formed by the queue management system such that users may avoid walking through the empty lanes formed by the queue management system.

11 Claims, 7 Drawing Sheets

(51) Int. Cl.
*E01F 13/04* (2006.01)
*E06B 11/08* (2006.01)

(56) References Cited

U.S. PATENT DOCUMENTS

| | | | | |
|---|---|---|---|---|
| 5,035,082 | A * | 7/1991 | Butler | E01F 13/06 49/334 |
| 7,000,289 | B2 | 2/2006 | Cedrone | |
| 7,098,807 | B2 * | 8/2006 | Seguin | E01F 13/06 340/907 |
| 7,506,860 | B2 * | 3/2009 | Stull | E06B 11/04 256/26 |
| 2005/0023403 | A1 | 2/2005 | Lu | |
| 2007/0257170 | A1 | 11/2007 | Whittemore | |
| 2012/0234990 | A1 * | 9/2012 | Lewis | E01F 13/028 248/122.1 |

FOREIGN PATENT DOCUMENTS

| | | | |
|---|---|---|---|
| EP | 0026166 | A1 | 4/1981 |
| FR | 1439232 | A | 5/1966 |

OTHER PUBLICATIONS

Web archive of Visiontron Corp. product website; archived Oct. 8, 2010.

Web archive of Visiontron product website;archived Oct. 10, 2010.

International Searching Authority, International Search Report, PCT/IB2014/064766, dated Jan. 8, 2015.

International Searching Authority, Written Opinion of the International Searching Authority, PCT/IB2014/064766, dated Jan. 8, 2015.

* cited by examiner

QUEUE MANAGEMENT GATE

PRIORITY

The present application is related to, and claims the priority benefit of, and is a 35 U.S.C. 371 national stage application of, International Patent Application Serial No. PCT/IB2014/064766, filed Sep. 23, 2014, which is related to, and claims the priority benefit of, Netherlands Patent Application Serial No. 2013358, filed Aug. 22, 2014, and Australian Patent Application Serial No. 2013903643, filed Sep. 23, 2013. The contents of each of these applications are hereby incorporated by reference in their entirety into this disclosure.

BACKGROUND

The present invention relates generally to a queue management gate and a method of using such a queue management gate and finds particular, although not exclusive, utility in reducing the length of a route from start to finish in a queue management system.

In this regard the term "queue" may be exchanged for the term "line" as this is the preferred expression in at least the USA.

Queues form where people have to wait to reach a point at which something occurs such as buying bread in bakers, presenting passports at custom desks in airports and the like. In some countries queues naturally form as people wait behind one another. However, sometimes the number of people waiting is relatively great such that the length of the queue becomes relatively long and potentially too long for the space available. Furthermore, in some countries queuing is not a natural phenomenon with people jostling one another to reach the front of the queue such that some people (for instance the infirm) may have difficulty ever reaching the front of the queue.

To improve these situations queue management systems have been developed. One such system is produced by Tensator® which comprises portable stanchions connectable together by retractable tapes to form a zig-zag pattern of adjacent lanes, such as shown in FIG. 11. In this way a greater number of people may form a queue in less space.

However, these queue management systems are often unattended by staff such that the sequence of lanes is maintained even when there are only a few people present. These people are therefore faced with having to walk backwards and forwards, possibly many times, often increasing the length of walk required by a factor of 5, in order to reach their destination despite the fact that there is no one, or only a few people, in front of them. If these people are carrying suitcases or having to push wheelchairs or children, or are simply infirm, the additional distance is frustrating and time consuming.

BRIEF SUMMARY

Therefore there is a need for an improved queue management system. In a first aspect, the invention provides, a queue management gate comprising an attachment device for attaching the queue management gate to a stanchion of the type used in queue management systems which include flexible tapes extending between stanchions to form lanes, the gate further comprising a relatively rigid movable barrier, movable in a substantially horizontal plane, the gate for allowing access between adjacent lanes formed by the queue management system.

The queue management gate, herein after referred to as "the QM gate", thus allows a movable barrier to be retrofitted to an existing stanchion in a queue management system in place of a barrier portion, such as a rectractable tape or rigid panel. The QM gate may be placed at the end of a first lane where a person would usually turn through 180 degrees to walk in the opposite direction along the second lane adjacent to the previous first lane. Instead, the person may merely turn through 90 degrees and pass through the gate into the next-but-one third lane thus missing-out the second lane. If more than one QM gate is installed along the side of a queue management system at every other lane then a route is provided which allows users to by-pass the lanes and instead proceed directly to the end of the route.

The QM gate may be biased to the position whereby it blocks the gap between adjacent lanes such that people have to push it open. The QM gates may be arranged such that they only open in one direction. In this way, they cannot be pushed open if other people are standing "behind" the gate. For instance, if people are already queuing in the destination lane they may block the opening of the gate. This allows for queue-jumping by people using the gates without authorisation to be substantially eliminated. Equally, if someone needs to reach the front of the queue and is allowed to queue-jump by the relevant authority (for instance because their flight is waiting for them) people may be asked to move out of the way from "behind" the gates to allow that person to reach the front of the queue quickly via the gates.

The QM gates may be arranged in locations other than at the end of lanes, for instance substantially in the middle.

The stanchions in the queue management system may be portable or fixed, or there may be some of both.

The barrier may be relatively rigid in that it is more rigid than a rectractable tape.

The barrier may be a relatively slender member having an approximate length of between 500 mm and 1500 mm, an approximate height of between 50 mm and 200 mm, and an approximate thickness of between 5 mm and 25 mm. In one example the barrier has dimensions of 1200 mm length, 150 mm height and 13 mm thickness. The barrier may be substantially longer than it is high. One version has the barrier in the form of a flexible filament, such as a whip.

The barrier may include a portion for including advertising and/or information. For instance, a relatively flat portion may be included on at least one side of the barrier for affixing decals and the like.

The attachment device may include a slot for releasably co-operating with a tab provided on the stanchion. The stanchions in the Tensator® system include tabs over which an end of a tape may be engaged with a corresponding slot. Accordingly, in one embodiment, the attachment means may include a socket for engaging with this tab. Means to attach to other known commercial barrier systems are contemplated. For instance, the slot may be replaced with engagement means for allowing the attachment device to attach to other existing stanchions. It is also possible that an adaptor may be included for attaching the QM gate to other types of existing stanchions. The adaptor may be a replaceable member which fits between the attachment means and the pre-existing stanchion. A variety of different adaptors may be provided.

The attachment device may include a socket for releasably receiving the top of the stanchion. In one example the socket may be pushed over the top of the stanchion. The socket may include resilient material. For instance, foam-like material may be employed. In this way the material may grip the top of the stanchion and hold the socket in place but allow it to be pulled off when required.

The attachment device may include a clamp for clamping the gate to the stanchion. The clamp may be arranged to be manually opened and closed. For instance, the clamp may have one or more surfaces which can be moved to squeeze against the stanchion to retain the QM gate thereto. One example may include a 'G' type clamp arrangement.

Other means for attaching the QM gate to the stanchion are contemplated such as gluing. In this regard the attachment may be considered non-releasable from the stanchion.

The QM gate may comprise a hinge for facilitating the pivoting of the barrier relative to the attachment device. The hinge may be a standard butt/mortise or barrel type hinge, but also may be a flexible portion arranged between the relatively rigid barrier and the attachment device. In one example, the flexible portion may be within the barrier but towards one end thereof.

The QM gate may include a biasing means for maintaining the position of the barrier relative to the attachment means. For instance, a spring may be included. This may aid the return of the barrier relative to the attachment means after it has been moved by a user.

The QM gate may comprise rotation means for facilitating the rotation of the barrier and attachment device relative to the stanchion. For instance, the attachment device may comprise an inner and outer part, the inner part arranged to attach to the stanchion and the outer part arranged to rotate relative to the inner part, the barrier being attached, or unitary with, the outer part. A race, or other sliding means, may be provided between the inner and outer parts to allow the two to move easily relative to one another.

The QM gate may comprise barrier movement means for automatically moving the barrier from a first position to a second position. Such means movement may include a spring or other resilient member. Another option comprises two opposing and relatively movable surfaces arranged at an angle lying between the vertical and horizontal, in use, such that the barrier has a greater height with the barrier in the first position as compared to the barrier being in the second position, and the weight of the barrier assists in moving the barrier from the first position to the second position. In this way the two surfaces slide relative to one another when the barrier moves and causes the barrier to lift up in the first, possibly open position. One surface may be arranged on the attachment means and the other on the barrier. Or, one surface may be arranged on the inner part, described above, and the other surface arranged on the outer part.

The QM gate may further comprise a barrier receiving means for fitting to another stanchion adjacent the queue management gate, the barrier receiving means arranged to receive the end of the barrier distal from the attachment means. The barrier receiving means may include attachment means for attaching it another stanchion. The attachment means may be the same as described above with regard to the QM gate. In other words, in a simple example, the barrier receiving means may push over the top of the stanchion.

The receiving means may include a socket, recess or other such arrangement in which the end of the barrier may be maintained in either or both of a closed and open position. In other words, the barrier receiving means may overcome the self-closing/automatic movement mechanism described above. This may be effected by a magnet provided in one of the barrier and barrier receiving means and an opposing magnet or magnetic member being provided in the other. The magnet may be an electromagnet. Other means of retaining the end of the barrier in the barrier receiving means are contemplated such as a catch.

In one example, the end of the barrier may be locked relative to the barrier receiving means preventing unauthorised movement thereof. The barrier may be unlocked by means of a key allowing the catch to be moved or an electronic signal switching off the electromagnet. The signal may be provided remotely via radio signals such as in a WI-FI network.

The QM gate may include an indicator for providing an indication of the lock status; such as an indication as to when it is locked and when it is unlocked. Such an indicator may be a visible signal such as a light or flag.

The QM gate may include a motor for moving the barrier. It may also include one or more sensors for determining the position of the barrier relative to the attachment means.

The attachment means may include a weight to reduce the likelihood of toppling and "creep", and increase the stabilisation, of the stanchion.

In a second aspect, the invention provides a queue management system comprising a plurality of stanchions connected together by barriers to form lanes in which people may queue, and at least one queue management gate according to the first aspect being located in place of a barrier extending between two adjacent stanchions, the gate for allowing access between adjacent lanes.

The barriers may be retractable flexible tapes and/or relatively rigid panels.

In a third aspect, the invention provides a method of reducing the length of a route, from start to finish, in a queue management system of the type which includes panels and/or flexible tapes extending between stanchions to form lanes, the method comprising the steps of providing a queue management system including panels and/or flexible tapes extending between stanchions to form lanes, providing a queue management gate according to the first aspect, removing a length of tape or panel between two adjacent stanchions and attaching the queue management gate to one of the two said adjacent stanchions such that the barrier in a first position blocks access between the two said adjacent stanchions and in a second position allows access therebetween, such that, in use, with the barrier in a second position the route is shortened by access between adjacent lanes being provided.

The method may further comprise the step of providing and installing further queue management gates in other locations within the queue management system.

In a fourth aspect, the invention provides a queue management device comprising a portable stanchion, having a base, and a relatively rigid barrier, pivotable relative to the stanchion in a substantially horizontal plane, the gate for allowing access between adjacent lanes formed by portable queue management systems of the type which include panels or flexible tapes extending between portable stanchions to form lanes.

The queue management device is referred to hereafter as "the QM device"

In this aspect the same principles as above apply but rather than being retro-fitted to an existing stanchion the device is a stanchion including a pre-assembled and attached movable barrier.

The stanchion may include tape attachment means for attaching a flexible tape from an adjacent stanchion thereto. For instance tabs and/or sockets for receiving tabs may be provided.

The stanchion may include panel support means for supporting panels which are supported at one end by another stanchion. The panels may be relatively rigid.

The QM device may comprise a hinge for facilitating the pivoting of the barrier relative to the stanchion. As before, the hinge may be a standard type door hinge and/or be a flexible portion arranged between the relatively rigid barrier and the stanchion.

The QM device may comprise rotation means for facilitating the rotation of the barrier relative to the stanchion. The rotation means may comprise an inner and outer part, one of the inner and outer parts fixed relative to the stanchion and the other of the inner and outer parts arranged to rotate relative thereto, the barrier being attached, or unitary with, the other of the inner and outer parts.

The QM device may comprise barrier movement means for automatically moving the barrier from a first position to a second position.

The barrier movement means may comprise two opposing and relatively movable surfaces arranged at an angle lying between the vertical and horizontal, in use, such that the barrier has a greater height with the barrier in the first position as compared to the barrier being in the second position, and the weight of the barrier assists in moving the barrier from the first position to the second position. The barrier movement means may move as discussed, mutatis mutandis, in relation to the first aspect above.

The QM device may further comprise a barrier receiving means for fitting to another stanchion adjacent the queue management device, the barrier receiving means arranged to receive the end of the barrier distal from the stanchion. In other words, the barrier receiving means may be retro-fitted to an existing stanchion. The details of this barrier receiving means are the same, mutatis mutandis, as described above in relation to the first aspect such that it may include locking means and a recess etcetera.

The QM device, however, may further comprise a barrier receiving means fitted to another stanchion adjacent the queue management device, the barrier receiving means arranged to receive the end of the barrier distal from the stanchion. In this version, the barrier receiving means is already pre-attached to the stanchion. The details of this barrier receiving means are the same, mutatis mutandis, as described above in relation to the first aspect such that it may include locking means and a recess etcetera.

In a fifth aspect, the invention provides a barrier-end receiving means for fitting to a stanchion of the type used in queue management systems which include flexible tapes extending between stanchions to form lanes, and a movable barrier, the barrier-end receiving means being arranged to maintain the end of the barrier in place relative thereto.

The barrier receiving means may include locking means for releasably retaining the end of the barrier in place relative thereto. For instance a physical catch or magnetics may be employed as described above with regard to the second and/or fourth aspects.

In a sixth aspect, the invention provides a queue management system comprising a plurality of stanchions connected together by panels and/or flexible tapes to form lanes in which people may queue, and at least one queue management device according to the fourth aspect being located in place of a panel or length of tape extending between two adjacent stanchions, the gate for allowing access between adjacent lanes.

The queue management system may comprise at least one sensor for detecting the presence of a queue of people. The queue management system may comprise at least one motor for moving the barrier of at least one queue management device. The movement of the barriers may be operated remotely in response to the detection of the presence and/or absence of a queue of people.

In a seventh aspect, the invention provides a method of reducing the length of a route, from start to finish, in a queue management system of the type which includes panels and/or flexible tapes extending between stanchions to form lanes, the method comprising the steps of providing a queue management system including panels and/or flexible tapes extending between stanchions to form lanes, providing a queue management device according to the fourth aspect, and inserting it between two adjacent stanchions in place of a panel or flexible tape such that the barrier in a first position blocks access between the two said adjacent stanchions and in a second position allows access therebetween, such that, in use, with the barrier in a second position the route is shortened by access between adjacent lanes being provided.

The method may further comprise the step of providing and installing further queue management devices in other locations within the queue management system.

In any of the various aspects the movable barrier may be telescopic such that its length may be selectable.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
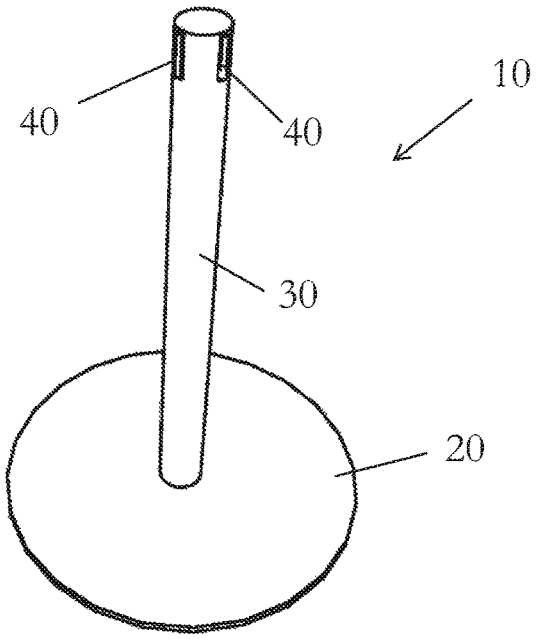
Prior Art Figure 1
FIG. 1 is a perspective view of a known stanchion used in queue management systems.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1 an existing stanchion 10 known from the prior art is shown in perspective. It comprises a post 30 supported by a circular foot or base 20. At the upper end of the post distributed equally around the perimeter are four features referenced 40 of which only two are visible. There are various different versions of stanchions known each version including a different arrangement of features 40. Some versions include only four tabs for receiving the end of a flexible tape or relatively rigid panel extending from an adjacent stanchion. Some include flexible extensible tapes which can be pulled out from the stanchion and releasably fixed to an adjacent stanchion.

Figure 2:
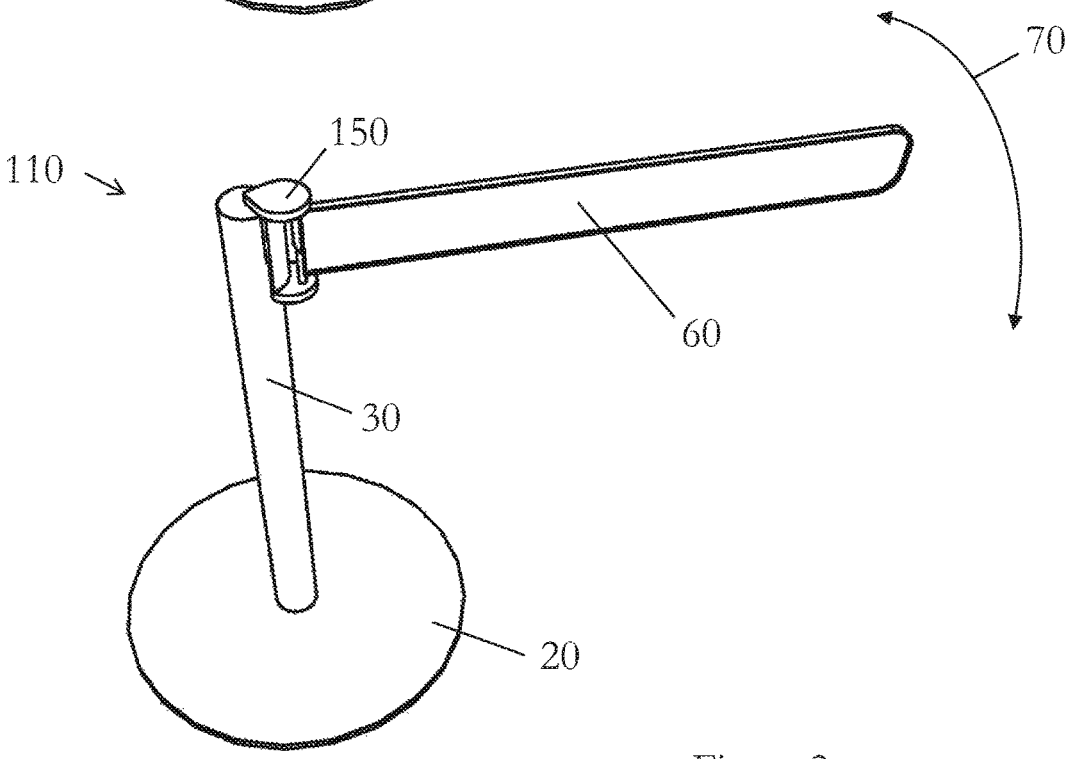
FIG. 2 is a perspective view of a stanchion including a queue management gate.

This type of known stanchion has been retro-fitted in FIG. 2 to include a queue management gate 110. The gate comprises a barrier 60 and an attachment device 150 which allows it to be attached to the top of the post 30. The barrier may move relative to the post (and/or the base 20) in a horizontal plane (indicated by arrow '70') so as to act as a movable barrier as will be explained in more detail below.

Figure 3:
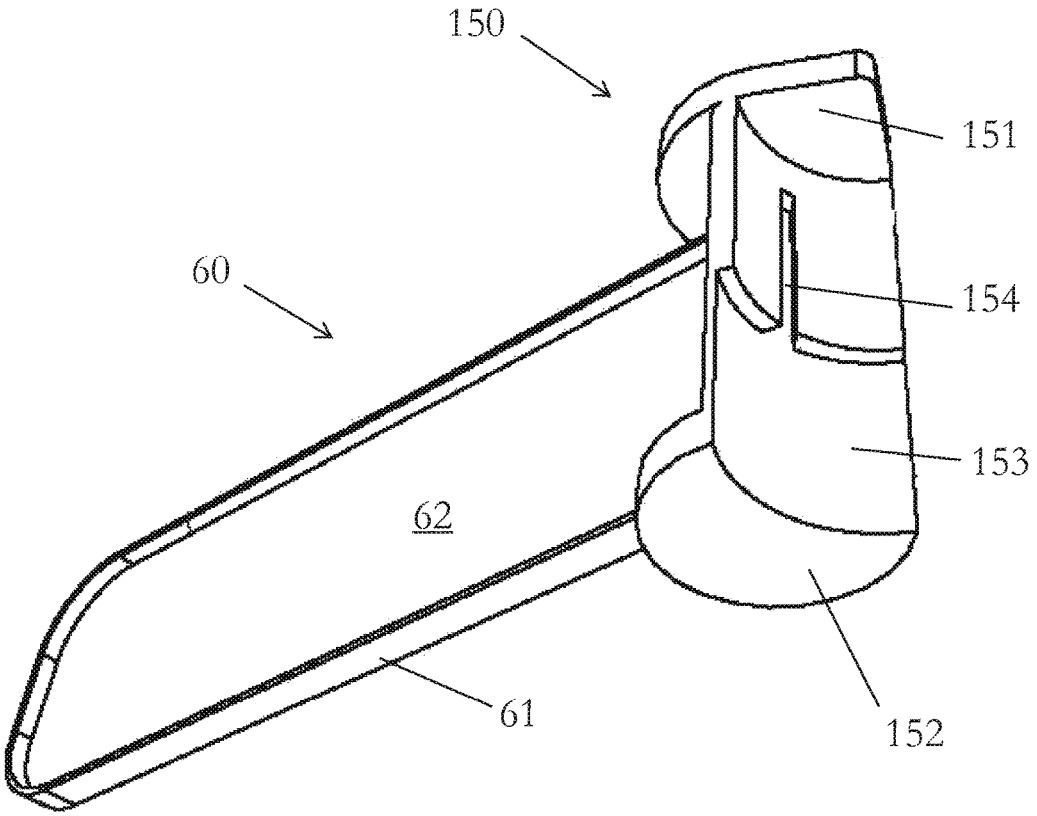
FIG. 3 is a perspective view of one version of a queue management gate.

The attachment device 150 is more dearly explained with reference to FIG. 3. The attachment device 150 includes a curved portion 153 configured to approximately match the curve of the outside of the post 30. A slot 154 is provided on the concave side of the curved portion to mate with the tab 40 provided on the outside of the post 30. In this way, the attachment device 150 may be slid downwardly relative to the post 30 so as to attach it to the post 30. The device 150 includes a top panel 151 which may help to stabilise the attachment device 150 relative to the post 30 and which extends partially across the top of the post 30 and radially outwardly from the post 30. It may act to prevent the ingress of unwanted materials such as dirt/dust into the region between the post 30 and the concave surface 153 of the attachment device 150.

The attachment device 150 includes a bottom panel 152 which extends radially away from the bottom. The barrier 60 is supported between the top panel 151 and the bottom panel 152.

The barrier 60 includes a thickened rim 61 around its perimeter which may provide stiffness and support to the relatively lightweight panel 62 within.

Figure 4:
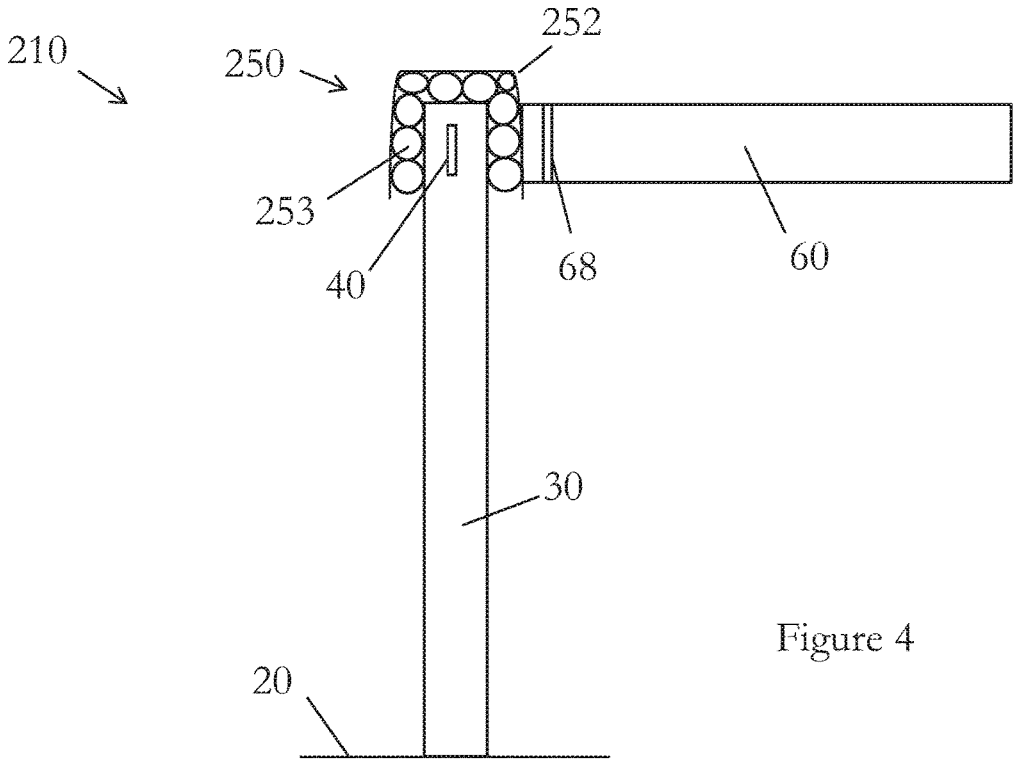
FIGS. 4 to 6 are side views of queue management gates including various attachment devices.

A side view of one version of the queue management gate 210 is shown in FIG. 4. This figure shows the attachment device 250 in cut-away section to better show the mechanism. It comprises a post 30 and base 20 of the known prior art stanchions retro-fitted with the queue management gate. The queue management gate has been attached by means of the attachment device 250 which comprises a socket, or cup, 252 which is pushed down over the top of the post 30. Sponge-like resilient material 253 is arranged annually in the socket 252 such that it grips the top of the post 30 but allows the queue management gate 210 to be removed when it needs to be moved to another stanchion.

The barrier 60 is pivoted to the attachment device 250 by means of a flexible portion, or hinge 68.

Figure 5:
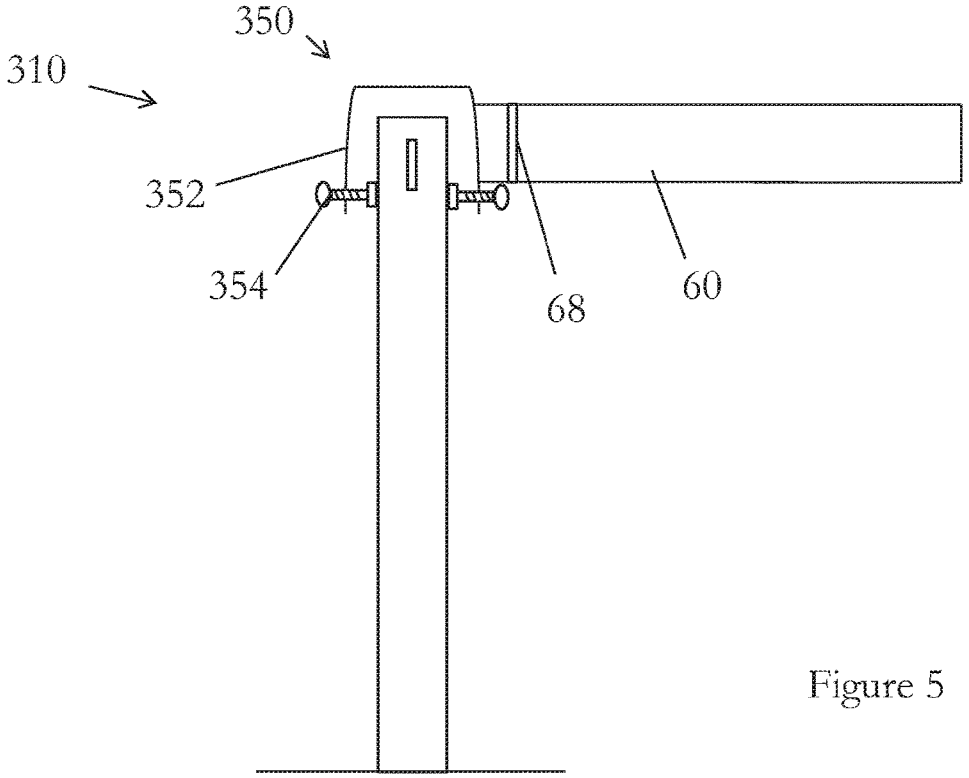

FIG. 5 shows a variation of the attachment device 350 wherein the queue management gate 310 is attached to the post 30 by means of clamps 354. This figure shows the attachment device 350 in cut-away section to better show the mechanism. These clamps are screw threads passing through the socket 352 with a tab at one end for grasping by the installer and a plate at the other end for pressing against the side of the top of the post 30 in a similar manner to a "G" clamp. The attachment device 350 may include any number of such clamps but a minimum of three is considered preferable to ensure adequate connection to the post 30.

In one version the attachment device 350 includes the resilient material 253 described with reference to FIG. 4 as well as the one or more clamps 354. Other ways of releasably attaching the queue management gate to a stanchion are contemplated such as gluing, strapping, tying, riveting and bolting.

Figure 6:
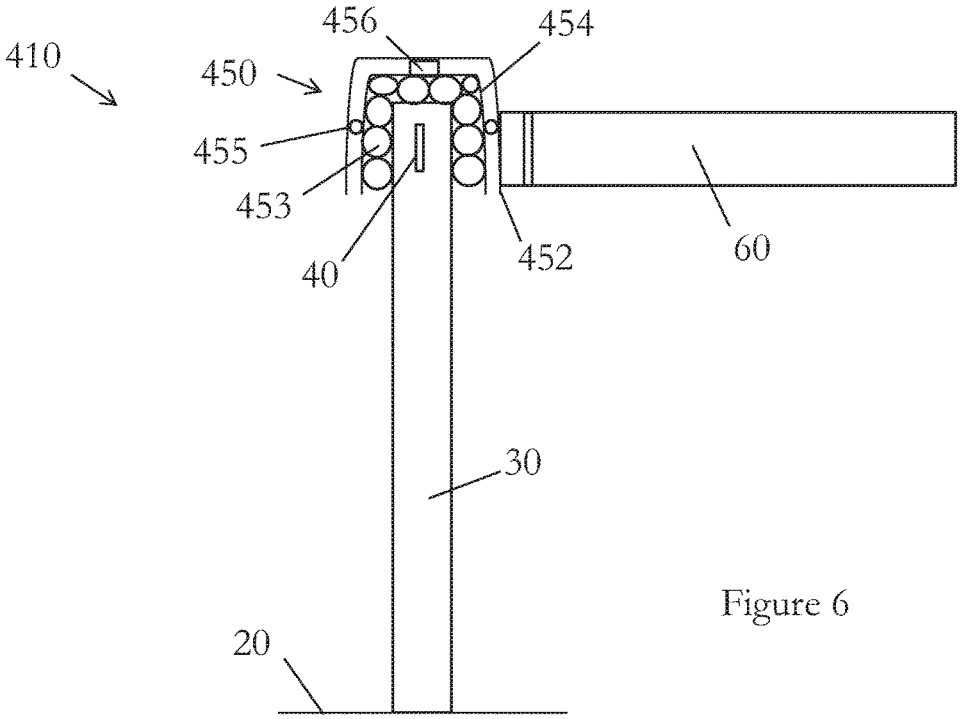

Yet another version of how the attachment device 450 may function is shown in FIG. 6. This figure shows the attachment device 450 in cut-away section to better show the mechanism.

Here the queue management gate 410 includes an attachment device 450 comprising in inner socket 454 and an outer part 452. The inner socket 454 is shown retained to the top of the post 30 by means of resilient material being present annually within the socket in a similar manner to that described above with reference to FIG. 4. However, other ways for attaching the inner socket to the top of the post 30 are contemplated such as discussed above.

The outer part 452 is arranged to rotate relative to the inner socket 45 so that the barrier 60 which is connected to, or unitary with, the outer part may rotate in the desired manner.

The inner socket 454 and outer part 452 are shown spaced apart by a turntable 456 provided at the top between the two 454, 452. Also shown is a race (such as a ball-bearing race) 455 around the circumference and in between the two 454, 452. It is possible to have only one of these two options or both. Other ways of allowing the two parts 454, 452 to rotate relative to one another are contemplated such as a bush, the presence of frictionless material and tracks.

Figure 7:
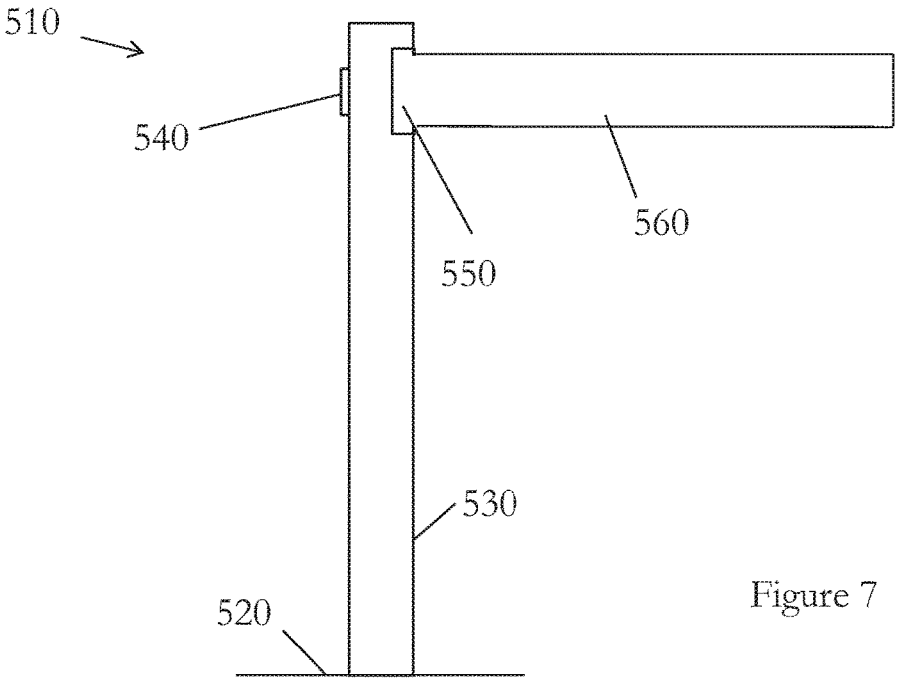
FIG. 7 is a side view of a queue management device.

FIG. 7 shows a side view of a queue management device 510 which comprises a post 530, a base 520 and a barrier 560 rotatably supported to the post 530 towards its top. The queue management device 510 includes tabs 540 (or the ends of flexible retractable tapes retained within the post 530 for extending therefrom) for creating a queue management system.

The barrier 560 is rotatably supported by the post 530 by a member 550 which may rotate within the post 530. The post includes a window within which the barrier and member 550 may move. The window may be used to limit the angle of rotation of the barrier 560. Such limitation may lie in the range 90 to 270 degrees although other ranges are contemplated.

The member 550 may be supported within the post 530 by an axle, ball-bearing race, bush, or other such mechanism as will be understood by the skilled person.

Figure 8:
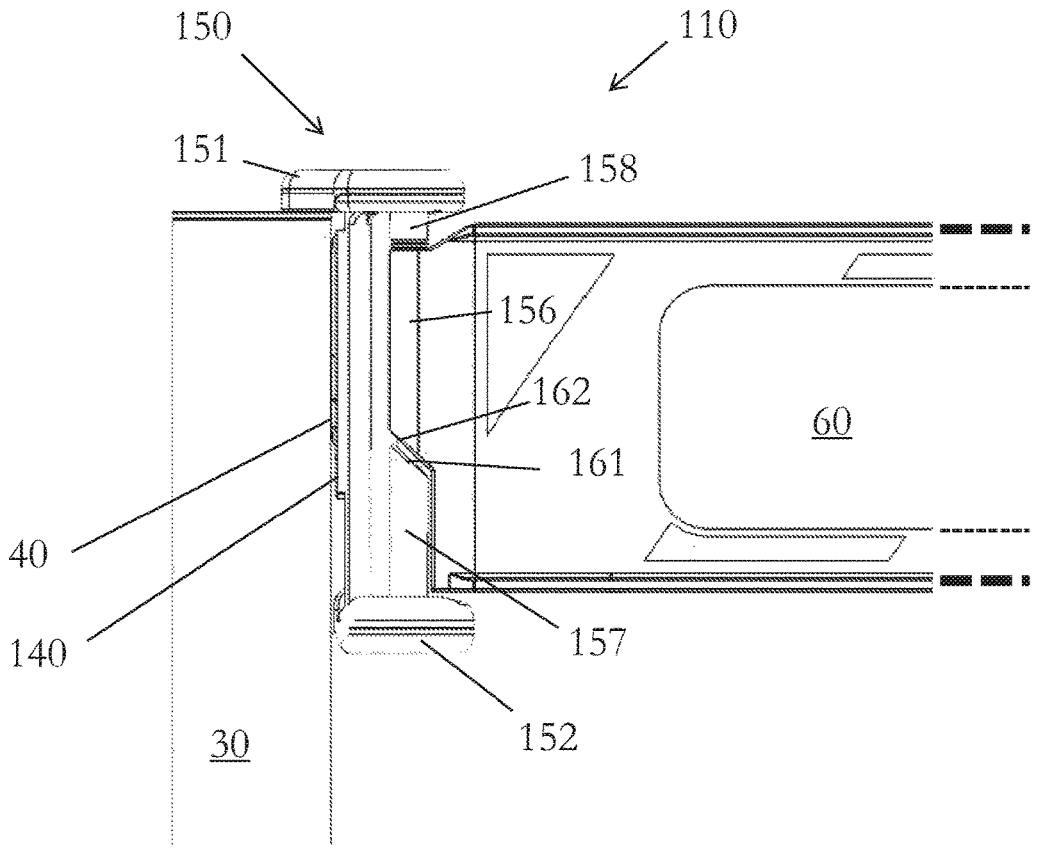
FIG. 8 is a close-up partial side view of a queue management gate.

In FIG. 8 the details of one way in which the attachment device 150 may function is shown. This attachment device is the same as the one described in relation to FIGS. 2 and 3 but includes a self-closing (or automatic movement) mechanism.

The attachment device 150 includes an axle 158 extending in an approximately vertical manner between the top panel 151 and the bottom panel 152. The barrier 60, of which only a portion is shown, may pivot around this axle 158 because it includes an upper portion 156 within which the axle 158 rests. A lower portion 157 is provided below this upper portion 156 and also has the axle 158 passing through it. The upper surface 161 of the lower portion 157 and the lower surface 162 of the upper portion 156 are correspondingly inclined relative to the horizontal lying at approximately 45 degrees thereto. This type of hinge is sometimes known as a self-rising hinge because as the upper portion 156 (and thus the barrier 60) rotates relative to the lower portion 157 the two surfaces 161, 162 slide over one another and due to their inclined natures the lower surface 162 and thus the upper portion 156 are urged away from the lower portion 157. The lower portion 157 is fixed relative to the attachment device 150 but the upper portion 156 may slide axially relative to the attachment device 150. For instance, the upper portion 156 may slide axially along the axle 158.

If the queue management device is arranged correctly then the weight of the barrier 60 will urge it to return to its lower position, once a force exerted upon it to move it initially has been removed.

This figure also shows the tab 40 provided on the outside of the post 30 and the connection part 140 within which the slot 154 is provided. The queue management device is shown attached to the post 30.

Figure 9:
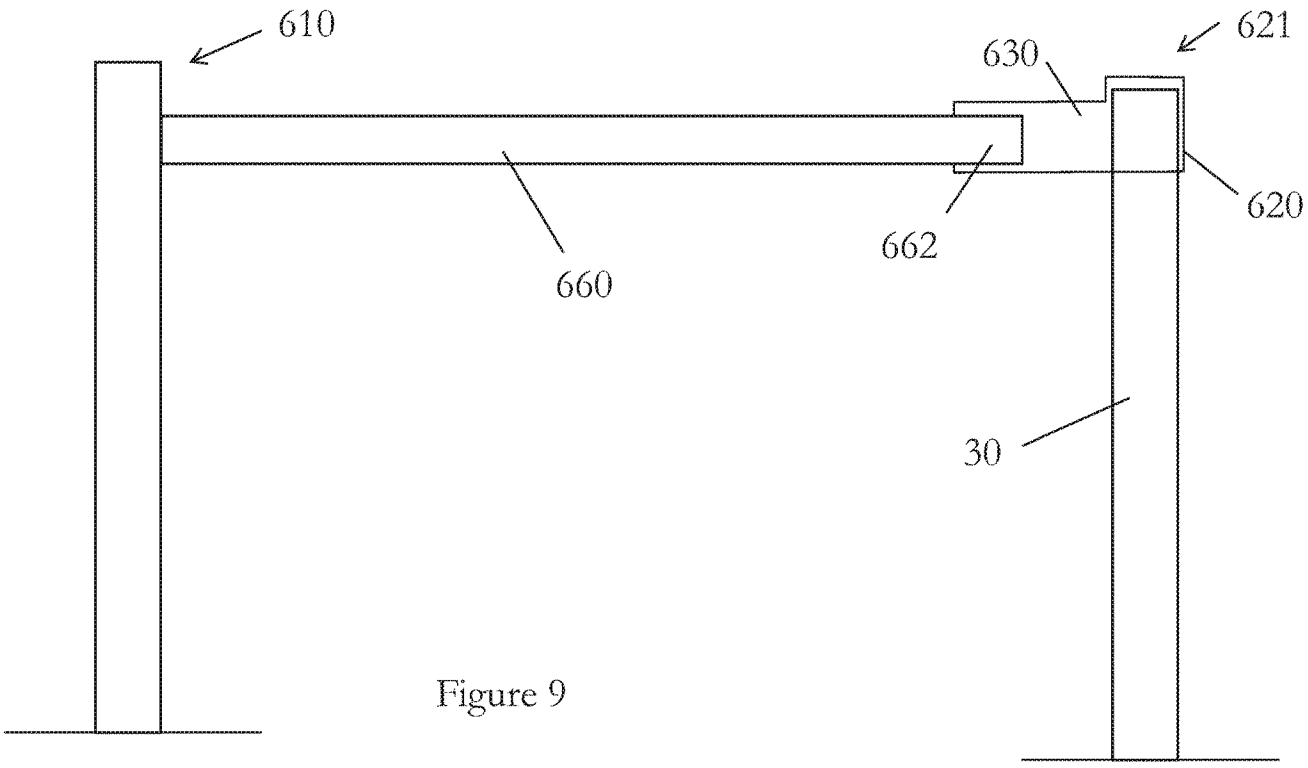
FIG. 9 is a side view of a barrier-end receiver.

In FIG. 9 a simplified queue management device 610 is shown including a barrier 660. An adjacent stanchion is shown to the right. This stanchion has a post 30 upon which a barrier-end receiving means 621 has been attached. This barrier-end receiving means 621 includes a socket 620 which has been pushed over the top of the post 30 in a similar manner to that described above with regard to the attachment device 250 in FIG. 4. This view is a cut-away section to improve the understanding thereof.

The barrier-end receiving means 621 is shown in cut-away section to improve the understanding thereof.

An arm 630 extends radially away from the socket part 620 within, or against which the end 662 of the barrier may abut, rest, or be retained.

Figure 10:
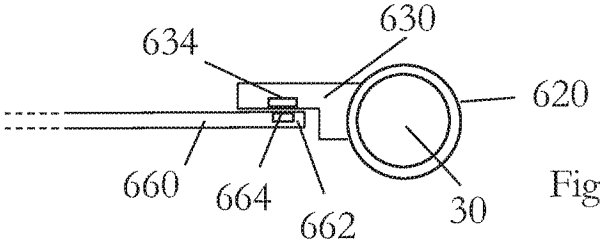
FIG. 10 is a plan view of part of the barrier-end receiver of FIG. 9.

An example of how the end 662 of the barrier 660 may be retained is shown in FIG. 10. Here the socket part 620 can be seen in cut-away section around the post 30. The arm 630 is shown including a recess against/within which the end 662 of the barrier 660 rests. The recess includes a magnet 634. The end 662 of the barrier includes another magnetic or some magnetically attractable material 664. The two 634, 664 are spatially arranged such that with the end 662 of the barrier 660 within the recess they may attract one another to the extent that the end of the barrier is substantially retained in place. The strength of the attraction may be arranged as required. It may vary from the only slight to the very strong. In the former, this may be desired such that users can easily overcome it but so that it stops the gate from being nudged out of place. In the latter, the strength may be enough such that the gate cannot be opened. In this regard one of the magnetic materials may be an electromagnet operated by management of the facility in which the queue management system is located.

Figure 11:
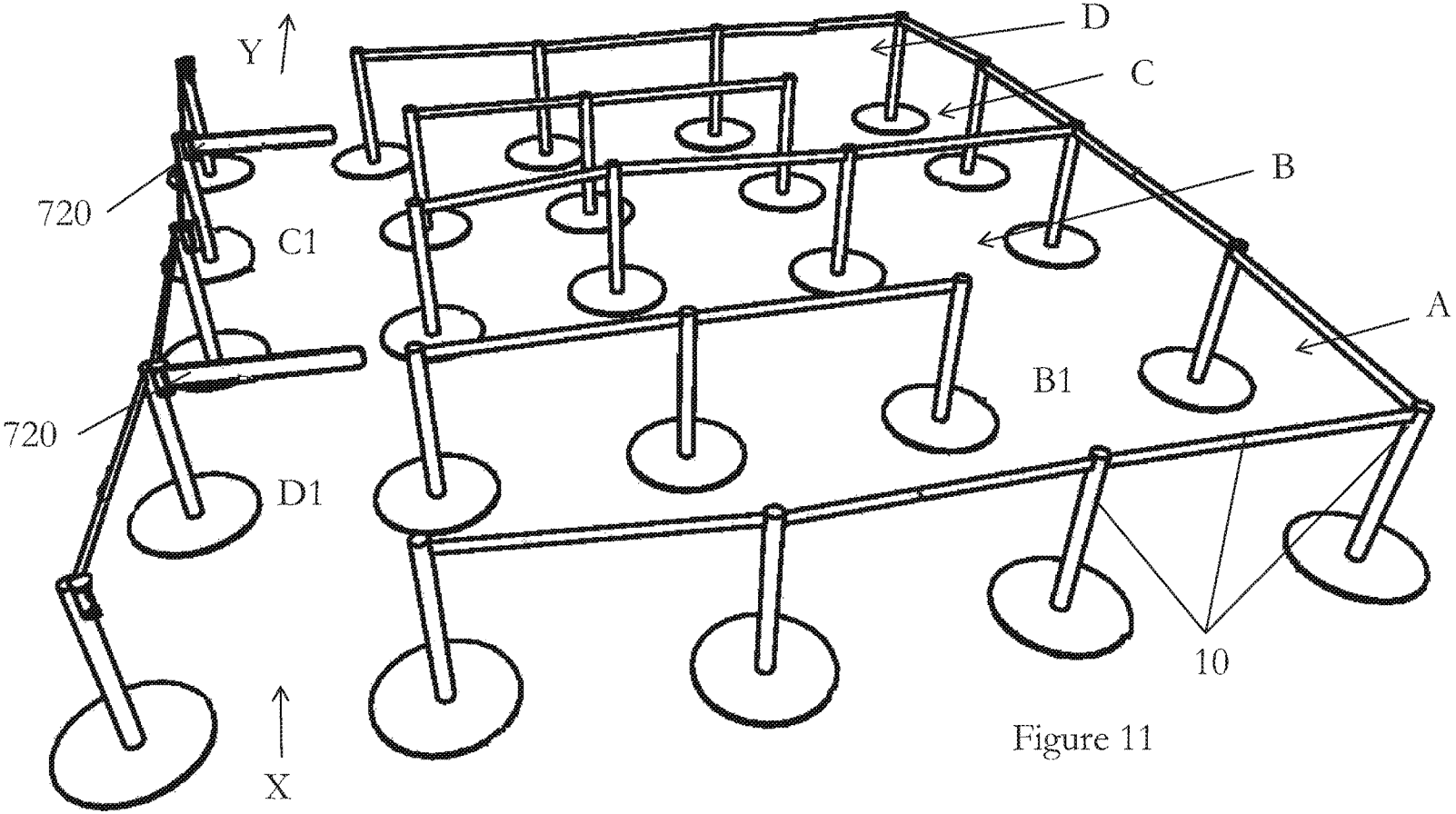
FIG. 11 is a perspective view of a queue management system.

Finally, FIG. 11 shows a queue management system 710 comprising known stanchions 10 arranged to create a labyrinth-like array of adjacent parallel lanes A, B, C, D with an entrance X at one end and an exit Y at the other end. The lanes are created by the use of the tapes being extended in a particular pattern between chosen adjacent stanchions. In use a person enters at X and turns right to walk along the first lane A. At the end of this lane A the person turns left through 90 degrees and passes through a gap B1 in the tapes to the end of lane B (opposite from the end of lane A at which they entered). The person then turns through another 90 degrees, such that they have turned through a total of 180 degrees, and progresses along the second lane B in the opposite direction to that which they traveled in lane A. At the end of lane B they pass through a gap C1 into the third lane and travel back along this third lane in the same direction as they traveled along the first lane A having turned through another 180 degrees. This is repeated for as many lanes as are present. In this figure there are 4 lanes and the user only reaches the exit Y after having traversed the full length of each lane A, B, C, D.

If the lanes are all empty this can be very frustrating for the user. Therefore queue management gates 720 have been provided attached to stanchions at the ends of the lanes in between the entrance X and the exit Y where those lanes are closed. In other words a queue management gate has been placed between lanes A and B, and between C and D.

Thus, if authorised to use these gates, the user may travel from the entrance X to the exit Y by-passing all of the lanes part from the widths thereof.

The system 710 may include sensors (not shown) for determining the status of queue. For instance, proximity sensors may provide an indication of the number of people present and which lanes are occupied. Furthermore, one or more gates 720 may include means for locking and unlocking and/or means for opening and closing. In this way, an operator may determine, whether visually or assisted by the sensors' output, that some of the gates may be opened or closed. For instance, if the queue extends from the exit Y and fills lanes C and D but no further then the operator may decide to open the gate located between lanes A and B so that users may avoid having to walk along the length of lanes A and B. If the queue becomes longer and extends before the entrance then this gate can be closed such that the lengths of lanes A and B may be used to reduce the space required to hold all the people in the queue.

The system may include a CPU for automatically monitoring the status of the queue/queue management system and for controlling the status of the various gates (open/closed, locked/unlocked).

The system 720 may also include markings such as located on the floor or on stanchions explaining how the queue management system operates and providing arrows to show the direction users should follow. For instance, signs including means for changing the direction of a displayed arrow may be incorporated.

The invention claimed is:

1. A queue management gate for attaching to a stanchion of the type used in queue management systems which include flexible tapes extending between stanchions to form lanes, the gate comprising a relatively rigid movable barrier attachable to the stanchion for allowing access between adjacent lanes formed by the queue management system, and comprising two opposing and relatively movable surfaces arranged at an angle lying between the vertical and horizontal, in use, such that the barrier has a greater height, relative to the stanchion, with the barrier in a first position as compared to the barrier being in a second position, and the weight of the barrier assists in moving the barrier from the first position to the second position.

2. The queue management gate according to claim 1, including a slot for releasably co-operating with a tab provided on the stanchion.

3. The queue management gate according to claim 1, including a socket for releasably receiving the top of the stanchion.

4. The queue management gate according to claim 1, including a clamp for clamping the gate to the stanchion.

5. The queue management gate according to claim 1, comprising a hinge for facilitating the pivoting of the barrier relative to the stanchion.

6. The queue management gate according to claim 1, comprising an inner and outer part, the inner part attachable to the stanchion and the outer part rotatable relative to the inner part, the barrier being attached, or unitary with, the outer part.

7. The queue management gate according to claim 1, comprising a motor for moving the barrier.

8. The queue management gate according to claim 1, comprising one or more sensors for determining the position of the barrier.

9. A queue management system comprising a plurality of stanchions connected together by barriers to form lanes in which people may queue, and at least one queue management gate according to claim 1 being located in place of a barrier extending between two adjacent stanchions, the gate for allowing access between adjacent lanes.

10. A method of reducing the length of a route, from start to finish, in a queue management system of the type which includes barriers comprising flexible tapes extending between stanchions to form lanes, the method comprising the steps of providing a queue management system including barriers extending between stanchions to form lanes, providing a queue management gate comprising a relatively rigid movable barrier and attaching it to a barrier of the barriers comprising the flexible tapes between two adjacent stanchions such that with the movable barrier in a first position it blocks access between the two said adjacent stanchions and in a second position it allows access therebetween, such that, in use, with the moveable barrier in the second position the route is shortened by access between adjacent lanes being provided.

11. A method of reducing the length of a route, from start to finish, in a queue management system of the type which includes panels and/or flexible tapes extending between stanchions to form lanes, the method comprising the steps of providing a queue management system including panels and/or flexible tapes extending between stanchions to form lanes, providing a queue management device, comprising a portable stanchion, having a base, and a relatively rigid barrier, pivotable relative to the portable stanchion, the device for allowing access between adjacent lanes formed by the queue management system, and inserting the device between two adjacent stanchions in place of a panel or flexible tape such that the barrier in a first position blocks access between the two said adjacent stanchions and in a second position allows access therebetween, such that, in use, with the barrier in the second position the route is shortened by access between adjacent lanes being provided.

* * * * *